US009622535B2

(12) United States Patent
Windham et al.

(10) Patent No.: US 9,622,535 B2
(45) Date of Patent: Apr. 18, 2017

(54) HELMETS AND HELMET FIT SYSTEMS

(71) Applicant: Cheung Kwai Kong, Gilroy, CA (US)

(72) Inventors: David Christian Windham, Altadena, CA (US); Silas Anthony Veloz, Sacramento, CA (US); Cheung Kwai Kong, Gilroy, CA (US)

(73) Assignee: Cheung Kwai Kong, Gilroy, CA (US)

( * ) Notice: Subject to any disclaimer, the term of this patent is extended or adjusted under 35 U.S.C. 154(b) by 0 days.

(21) Appl. No.: 14/798,866

(22) Filed: Jul. 14, 2015

(65) Prior Publication Data

US 2016/0051000 A1 Feb. 25, 2016

Related U.S. Application Data

(60) Provisional application No. 62/040,960, filed on Aug. 22, 2014, provisional application No. 62/133,700, filed on Mar. 16, 2015.

(51) Int. Cl.
*A42B 3/14* (2006.01)

(52) U.S. Cl.
CPC ..... *A42B 3/145* (2013.01)

(58) Field of Classification Search
CPC ..... A42B 3/14; A42B 3/142; A42B 3/145; A42B 3/147
USPC ..... 2/417, 418, 420, 421
See application file for complete search history.

(56) References Cited

U.S. PATENT DOCUMENTS 5,638,551 A 6/1997 Lallemand
5,659,900 A 8/1997 Arney et al.
5,983,405 A * 11/1999 Casale ..... A42B 3/145 2/417
6,854,133 B2 2/2005 Lee et al.
6,912,736 B2 * 7/2005 Moeller ..... A42B 3/145 2/416
7,222,374 B2 5/2007 Musal et al.
7,854,024 B2 12/2010 Fang
8,032,993 B2 10/2011 Musal
8,037,548 B2 * 10/2011 Alexander ..... A42B 3/127 2/417
8,156,574 B2 * 4/2012 Stokes ..... A42B 3/145 2/417
2007/0044210 A1 3/2007 Muller
2007/0245466 A1 * 10/2007 Lilenthal ..... A42B 3/14 2/416
2010/0050324 A1 3/2010 Musal
(Continued)

OTHER PUBLICATIONS

Two photographs of prior art helmet taken on Jul. 9, 2015.

*Primary Examiner* — Anna Kinsaul
*Assistant Examiner* — Griffin Hall
(74) *Attorney, Agent, or Firm* — Dascenzo Intellectual Property Law, P.C.

(57) ABSTRACT

Helmets and helmet fit systems are disclosed herein. The helmets include a shell and the helmet fit system. The helmet fit system includes a passive adjustment mechanism. The passive adjustment mechanism is configured to automatically and passively vary a length of a perimeter that is defined by the helmet responsive to a tension force that is applied to the passive adjustment mechanism by a remainder of the helmet. Some helmet fit systems further include a manual adjustment mechanism configured to receive user input for selectively increasing and decreasing the length of the perimeter.

13 Claims, 7 Drawing Sheets

(56) References Cited

U.S. PATENT DOCUMENTS

| | | | | |
|---|---|---|---|---|
| 2011/0191946 | A1* | 8/2011 | Fang | A42B 3/145 2/418 |
| 2012/0144565 | A1* | 6/2012 | Huh | A42B 3/145 2/421 |
| 2012/0167281 | A1* | 7/2012 | Gennrich | A42B 3/145 2/410 |
| 2012/0204330 | A1 | 8/2012 | Albouy | |
| 2015/0026871 | A1* | 1/2015 | Gotti | A42B 3/0406 2/418 |

* cited by examiner

HELMETS AND HELMET FIT SYSTEMS

RELATED APPLICATIONS

This application claims priority to U.S. Provisional Patent Application No. 62/040,960, which was filed on Aug. 22, 2014, and to U.S. Provisional Patent Application No. 62/133,700, which was filed on Mar. 16, 2015, and the complete disclosures of which are hereby incorporated by reference.

FIELD

The present disclosure relates generally to helmets and helmet fit systems.

BACKGROUND

Helmets may be utilized to protect a wearer's head from impact damage and/or injury that may be incurred while participating in various activities. As examples, helmets may be utilized when the wearer is participating in sports activities, such as cycling, snow skiing, snowboarding, water skiing, kayaking, canoeing, rock climbing, mountaineering, rappelling, abseiling, canyoning, sailing, boating, and the like. Additionally or alternatively, helmets also may be utilized when the wearer is participating in non-sports activities, such as during participation in industrial, commercial, and/or construction activities. Under these conditions, the helmet also may be referred to as a hard hat.

Helmets may include a helmet fit system, and the helmet fit system may be adjusted to provide a proper, correct, and/or desired fit for the helmet on the wearer's head. Traditional helmet fit systems are manually, and often incrementally (or discretely) adjustable. However, such manual, incremental, and/or discrete adjustment may be inconvenient for some wearers and/or may not provide a desired fit on some wearers' heads. Thus, there exists a need for improved helmets and helmet fit systems.

SUMMARY

Helmets and helmet fit systems are disclosed herein. The helmets include a shell and the helmet fit system. The helmet fit system includes a passive adjustment mechanism. The passive adjustment mechanism is configured to automatically and passively vary a length of a perimeter that is defined by the helmet responsive to a tension force that is applied to the passive adjustment mechanism by a remainder of the helmet.

In some embodiments, the helmet fit system further includes a manual adjustment mechanism. In some embodiments, the manual adjustment mechanism is operatively coupled to the shell and, together with the shell, defines the perimeter. In some embodiments, the manual adjustment mechanism is configured to receive a user input for selectively increasing and/or decreasing a length of the perimeter.

In some embodiments, the passive adjustment mechanism interconnects a left arm and a right arm of the helmet fit system. In some embodiments, the passive adjustment mechanism includes a pair of mounts and a flexible and elongate body that extends between the pair of mounts. In some embodiments, the pair of mounts includes an overmold region and the resilient and flexible body is molded around the overmold region.

DESCRIPTION

Figure 1:
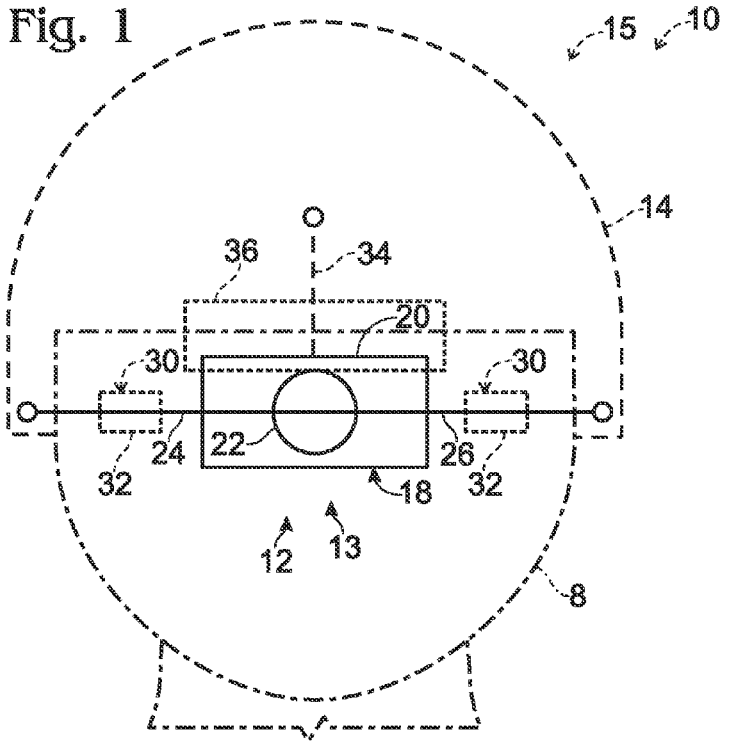
FIG. 1 is schematic rear view representing helmet fit systems and helmets according to the present disclosure.

Helmets and helmet fit systems according to the present disclosure may be worn by (or designed for and/or intended to be worn by) children and/or adults. Some helmets and helmets fit systems according to the present disclosure may be specifically designed, sized, and/or intended to be worn by children, while other helmets and helmet fit systems according to the present disclosure may be specifically designed, sized, and/or intended to be worn by adults. That said, a helmet fit system that is designed for a child may be worn by an adult and/or may be used in a helmet that is sized for an adult, and a helmet fit system that is designed for an adult may be worn by a child and/or be used in a helmet that is sized for a child.

FIGS. 1-32 provide examples of helmet fit systems 12, according to the present disclosure, and/or of helmets 10, according to the present disclosure, that may include and/or utilize helmet fit systems 12. Elements that serve a similar, or at least substantially similar, purpose are labeled with like numbers in each of FIGS. 1-32, and these elements may not be discussed in detail herein with reference to each of FIGS. 1-32. Similarly, all elements may not be labeled in each of FIGS. 1-32, but reference numerals associated therewith may be utilized herein for consistency. Elements, components, and/or features that are discussed herein with reference to one or more of FIGS. 1-32 may be included in and/or utilized with any of FIGS. 1-32 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a given embodiment without departing from the scope of the present disclosure.

FIGS. 1-4 schematically illustrate helmets 10 according to the present disclosure, including helmet fit systems 12 according to the present disclosure. In FIGS. 1-4, helmets 10 are schematically illustrated in dashed lines, schematically representing that a helmet fit system 12 may be provided separate from the rest of a helmet, for example, to be subsequently installed as part of a helmet. FIGS. 1-4 also schematically illustrate in dash-dot lines, a head 8 of a wearer of the respective helmets represented.

As schematically illustrated, helmets 10 typically include a helmet fit system 12, a shell 14, and a chin restraint assembly 16. Shell 14 defines an internal cavity for receipt of an upper portion of wearer's head 8 and often may be formed at least partially of a foam material. The shell provides protection against impact to the wearer's head. Helmet fit system 12 is coupled to the shell and provides a mechanism for adjusting a fit of the helmet to the wearer's head. The chin restraint assembly provides a mechanism for securing the helmet to the wearer's head.

Figure 2:
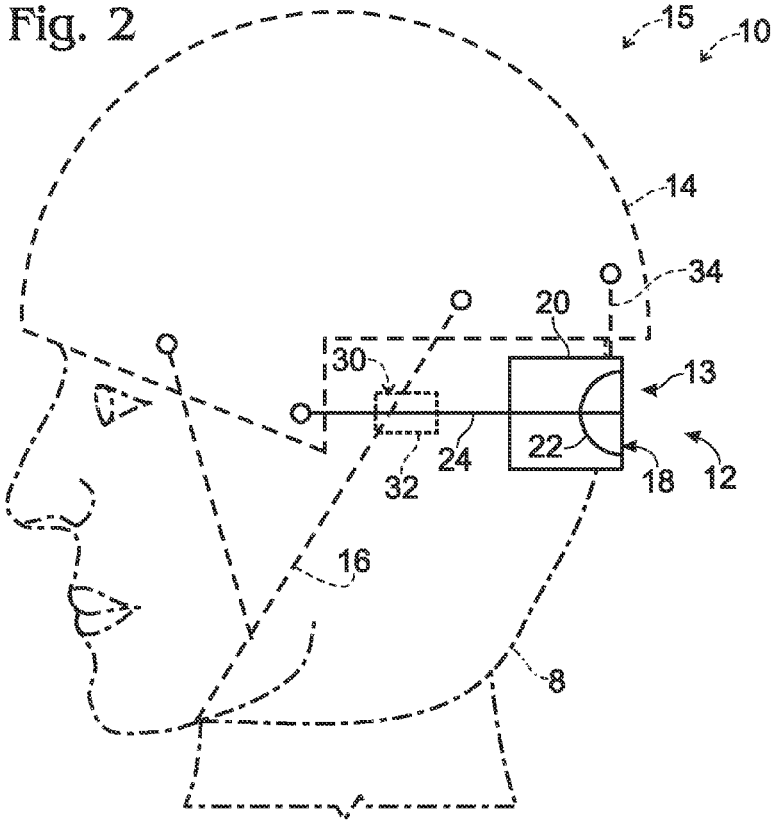
FIG. 2 is a schematic side view representing the helmet fit systems and helmets of FIG. 1.

With reference first to FIGS. 1-2, the schematically represented helmet fit systems 12 may include a manual adjustment mechanism 18 that is configured to permit a user to selectively adjust the fit of the helmet fit system, and thus the helmet, on the wearer's head 8. Such examples of helmet fit systems 12 are referenced herein as helmet fit systems 13, and helmets 10 that include helmet fit systems 13 are referenced herein as helmets 15. Although not limited to use by adults, helmets 15 may be well suited for use by adults.

Manual adjustment mechanism 18 of helmet fit systems 13 may be described as being configured to receive user input for selective adjustment of the helmet fit system 13, and more specifically for adjustment by a user to selectively increase and/or decrease the tightness or looseness of the helmet fit system on the wearer's head 8. Stated differently, the helmet fit system and the shell may be described as collectively defining a perimeter within which the wearer's head is positioned when the helmet is worn properly, and manual adjustment mechanism 18 provides a mechanism for selectively increasing and/or decreasing a length of the perimeter so as to permit for selectively donning the helmet, tightening the helmet on the wearer's head, and loosening and/or removing the helmet from the wearer's head.

In the schematically illustrated examples of FIGS. 1-2, manual adjustment mechanism 18 includes an adjuster assembly 20 having a user input member 22, and a left arm 24 and a right arm 26 that interconnect the adjuster assembly and left and right regions of the helmet's shell 14, respectively. The user input member is configured to selectively receive user input and operatively translate the left and right arms relative to the adjuster assembly. Various examples of adjuster assemblies 20 and user input members 24 are within the scope of the present disclosure. As examples, the user input member may include one or more of a rotatable wheel, a rotatable drum, a sliding member, a ratchet member, a button, a lever, a clasp, etc., which, when manipulated by the user, selectively tightens and/or loosens the helmet fit system. For example, in the example of a rotatable wheel or drum, rotation of the wheel in a first direction may tighten the helmet fit system, while rotation of the wheel in a second, or opposite, direction may loosen the helmet fit system. In the example of a sliding member, translation of the sliding member in a first direction may tighten the helmet fit system, while translation of the sliding member in a second, or opposite, direction may loosen the helmet fit system. Other examples also are within the scope of the present disclosure.

Figure 5:
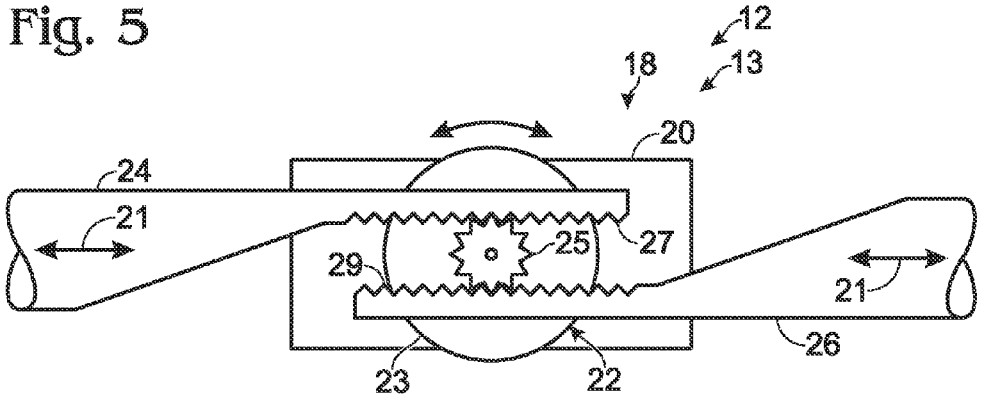
FIG. 5 is a schematic rear view representing manual adjustment mechanisms for helmet fit systems and helmets according to the present disclosure.

In some examples, the left and right arms include teeth or gears, such as in the form of a rack gear, and the adjuster assembly includes corresponding teeth or gears engaged with the left and right arms and configured to permit for selective tightening and loosening of helmet fit system 13. FIG. 5, somewhat less schematically than FIGS. 1-2, represents such examples of manual adjustment mechanisms 18. More specifically, as illustrated, the adjuster assembly 20 supports a user input member 22 in the form of an input wheel 23 and a pinion gear 25 that is operatively coupled to the input wheel. The left arm 24 includes a rack 27 operatively meshed with the pinion gear, and the right arm 26 includes another rack 29 operatively meshed with the pinion gear. While the rack of the left arm is illustrated as being on the upper side of the pinion gear and the rack of the right arm is illustrated as being on the lower side of the pinion gear, the opposite configuration also is within the scope of the present disclosure.

In the illustrated example, when a user operatively rotates the input wheel in the clockwise direction, the left arm translates to the right, the right arm translates to the left, and the helmet fit system 13 therefore reduces the length of the perimeter defined by the helmet fit system and the shell and thus tightens the helmet fit system. When a user operatively rotates the input wheel in the counterclockwise direction, the left arm translates to the left, the right arm translates to the right, and the helmet fit system 13 therefore increases the length of the perimeter defined by the helmet fit system and the shell and thus loosens the helmet fit system. Additionally, as schematically represented in FIG. 5, the left arm 24 and the right arm 26 may be configured, for example, may be shaped, such that the center, or axis, of tension 21 of the helmet fit system 13 is generally coaxial between the left and right arms, despite one of the left and right arms extending above the pinion gear 25 and the other of the left and right arms extending below the pinion gear. In such configurations, the overall fit of the helmet fit system is maintained in a desired alignment with wearer's head 8, and the tightening of the helmet fit system does not result in an undesirable twist, or torque, relative to the wearer's head.

Additionally or alternatively, in some examples, the manual adjustment mechanism 18 may be configured to provide a discrete and/or finite number of adjustments, or positions, of the manual adjustment mechanism. For example, with the examples of the utilization of teeth or gears, the teeth or gears may define the finite number of adjustments. Additionally, the size and spacing of the teeth or gears may define discrete adjustments, or positions, that result in discrete lengths of the perimeter defined by the helmet fit system and the shell. As examples, manual adjustment mechanism 18 may provide for adjustment of the length of the perimeter defined by the helmet fit system and the shell in increments of 1, 2, 3, 4, 5, 1-5, 2-5, 3-5, 4-5, 1-4, 2-4, 3-4, 1-3, 2-3, 1-2, less than 1, or more than 5 millimeters (mm).

Components of helmet fit systems 13 may be constructed of any suitable material. As examples, the left and right arms of the manual adjustment mechanism may be constructed of a molded plastic that is resilient and flexible in a lateral direction and stiff in a longitudinal direction. That is, the left and right arms may be configured to temporarily bend and generally conform to the shape of a rear of wearer's head 8 (as illustrated in FIGS. 1-2) when the helmet fit system's manual adjustment mechanism 18 is selectively manipulated to tighten the helmet fit system. However, the left and right arms may not (at least significantly) stretch longitudinally when the helmet fit system is tightened by the manual adjustment mechanism.

Although not required, in some examples of helmet fit systems 13, manual adjustment mechanism 18 may be configured such that user input member 22 requires the same, or at least approximately the same, amount of input force from a user to selectively tighten helmet fit system 13 as is required to selectively loosen the helmet fit system. Stated another way, in some examples, the manual adjustment mechanism may be described as not being biased toward one of a loosening or tightening direction.

As schematically illustrated in dashed lines in FIGS. 1-2, helmet fit systems 13 optionally may include one or more passive adjustment mechanisms 30. As used herein, a passive adjustment mechanism 30 is a structure, assembly, or other mechanism that contributes to and/or facilitates, at least in part, the adjustment and fit of the helmet fit system and associated helmet on a wearer's head 8. More specifically, similar to manual adjustment mechanism 18, an optional passive adjustment mechanism 30 may provide for the increase and/or decrease of the length of the perimeter defined by the helmet fit system and the shell, such as over a range of lengths. However, unlike manual adjustment mechanism 18 of helmet fit system 13, optional passive adjustment mechanisms 30 are not configured to receive a direct user input to facilitate adjustment thereof. Instead, an adjustment contribution provided by optional passive adjustment mechanism 30 may occur automatically, naturally, and/or passively, and may be described as facilitating a snug and/or secure fit of the helmet fit system and the helmet on the wearer's head.

Additionally or alternatively, optional passive adjustment mechanism 30 may be described as providing micro-adjustments for the helmet fit system, whereas a manual adjustment mechanism 18 may be described as providing macro-adjustments. Additionally or alternatively, optional passive adjustment mechanism 30 may provide for adjustments of the helmet fit system that otherwise fall between the discrete adjustments of the manual adjustment mechanism. For example, manual adjustment mechanism 18 may be configured to increase and decrease the length of the perimeter defined by the helmet fit system and the shell by 3 mm increments, including settings that result in perimeters of 500 mm and 503 mm when the helmet is not being worn, whereas the corresponding perimeter of the wearer's head may be 501 mm. In embodiments of helmet fit systems 13 that do not include one or more passive adjustment mechanisms 30, a setting of 500 mm may be too tight, or uncomfortable, for the wearer, and a setting of 503 mm may be too loose, and possibly not secure, for the wearer. Stated another way, manual adjustment mechanism 18 may be described as having, or defining, a plurality of discrete adjustments that individually adjust the length of the perimeter.

In contrast, passive adjustment mechanism 30 may be described as being configured to adjust the length of the perimeter between adjacent adjustments of the plurality of discrete adjustments. Additionally or alternatively, passive adjustment mechanism 30 may be described as permitting an infinite amount of variation between adjacent adjustments of the plurality of discrete adjustments that may be defined, or provided, by the manual adjustment mechanism. In embodiments of helmet fit systems 13 that include one or more optional passive adjustment mechanisms 30, the slack, or extra perimeter length, associated with a setting of 503 mm may be taken up, consumed, and/or otherwise adjusted by the passive adjustment mechanisms, resulting in a snug and/or appropriate fit of the helmet fit system and the helmet on the wearer's head. The values used in this example are provided for illustration purposes only and do not limit the scope of adjustments provided by helmet fit systems 13.

Although not required, in some examples of helmet fit systems 13, optional passive adjustment mechanisms 30 may be described as providing a lesser extent of adjustment than manual adjustment mechanism 18. Stated differently, the manual adjustment mechanism may be configured to provide for a greater extent of increasing and decreasing the length of the perimeter defined by the helmet fit system and the shell than passive adjustment mechanisms 30 are configured to provide.

Passive adjustment mechanisms 30 may take any suitable form and/or configuration such that they contribute to and/or facilitate, at least in part, the adjustment and fit of a helmet fit system 12 and associated helmet 10 on a wearer's head 8 without direct user input to the passive adjustment mechanism. By "without direct user input", it is meant that a passive adjustment mechanism 30 is not designed, configured, or otherwise intended to be directly manipulated, for example, by a user's hand, for adjustment of the helmet fit system when donning and adjusting helmet 10 on wearer's head 8. However, passive adjustment mechanism 30 may be indirectly manipulated, in so far as when a user selectively adjusts manual adjustment mechanism 18 of helmet fit system 13, the passive adjustment mechanism may be indirectly modified, changed, moved, deformed, and/or otherwise affected by, or responsive to, direct user input to the manual adjustment mechanism.

Optional passive adjustment mechanisms 30, when present, may be operatively coupled to left arm 24 and/or to right arm 26 of helmet fit system 13. Additionally or alternatively, one or both of the left arm and the right arm may include a passive adjustment mechanism 30. Additionally or alternatively, a passive adjustment mechanism 30 may operatively couple the left and/or the right arm to the shell of the helmet. Additionally or alternatively, a passive adjustment mechanism 30 may operatively couple the left and/or the right arm to adjuster assembly 20. Additionally or alternatively, a passive adjustment mechanism 30, when present, may be positioned generally on a lateral side of wearer's head 8 when the helmet is donned by the wearer, such as schematically represented in FIG. 2.

Figure 6:
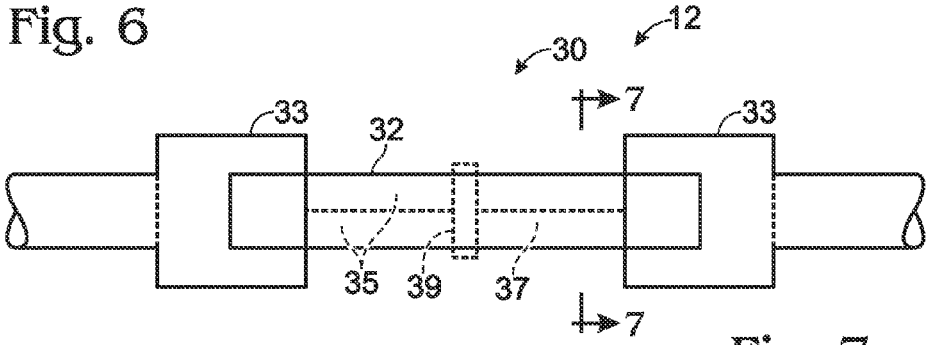
FIG. 6 is a schematic view representing passive adjustment mechanisms for helmet fit systems and helmets according to the present disclosure.

Passive adjustment mechanism 30 may include any suitable material and/or structure and/or may be formed and/or defined in any suitable manner. As an example, passive adjustment mechanism 30 may include a resilient and flexible body 32 that is configured to reversibly stretch in a longitudinal direction aligned with the perimeter defined by the helmet fit system and the shell. FIG. 6, somewhat less schematically than FIGS. 1-2, represents such examples of passive adjustment mechanisms 30. As schematically illustrated, the resilient and flexible body 32 may extend between two mounts 33. In connection with helmet fit systems 13, mounts 33 may be integral to or operatively coupled to the left and/or to the right arms. Additionally or alternatively, one of the two mounts associated with a passive adjustment mechanism 30 may be integral to or operatively coupled to the shell of the helmet, depending on the configuration of the helmet fit system incorporating the passive adjustment mechanism.

Mounts 33 may include and/or be any suitable structure that may, or may be utilized to, operatively couple flexible body 32 to another portion of helmet fit system 12 or helmet 10, such as left arm 24, right arm 26, shell 14, and/or adjuster assembly 20. As an example, mount 33 may include and/or be a fastener, such as a cap 128 of FIGS. 15-16 and 21-23 and corresponding cap screws that interlock with cap 128. As another example, mount 33 may include and/or be an interlocking structure that operatively interlocks flexible body 32 to the other portion of helmet fit system 12. An example of the interlocking structure includes an overmold region 140, as illustrated in FIGS. 8-14.

In some examples, resilient and flexible body 32 is configured to reversibly stretch to a greater extent than the left and right arms elastically stretch under the same tightening, or tension, force, which may be applied by the helmet fit system. Examples of suitable materials from which resilient and flexible body 32 of passive adjustment mechanism 30 may be constructed include (but are not limited to) rubber, synthetic rubber, elastic, plastic, elastomer, thermoplastic, thermoplastic polyurethane (TPU), soft TPU, thermoplastic elastomer (TPE), soft TPE, and/or thermoplastic rubber.

Additionally or alternatively, a material from which the resilient and flexible body may be constructed may have a modulus of elasticity, or Young's modulus, in the range of 1-5, 1-4, 1-3, 1-2, 2-5, 2-4, 2-3, 3-5, 3-4, or 4-5 megapascals (MPa). Additionally or alternatively, the resilient and flexible body may not plastically deform unless stretched to greater than 2-8, 2-6, 2-4, 4-8, 4-6, or 6-8 times its non-stretched length. Additionally or alternatively, the resilient and flexible body of passive adjustment mechanism 30 may be configured to elastically deform when stretched to 1.1-2, 1.1-1.5, 1.1-1.2, 1.2-2, 1.2-1.5, or 1.5-2 times its non-stretched length under a longitudinal tensile force associated with donning a helmet 10. Additionally or alternatively, the resilient and flexible body of passive adjustment mechanism 30 may be configured to stretch, elastically stretch, or deform along its length by 1-50, 1-40, 1-30, 1-20, 1-10, 10-50, 10-40, 10-30, 10-20, 20-50, 20-40, 20-30, 30-50, 30-40, or 40-50 mm under a longitudinal tensile force associated with donning a helmet 10 and/or without plastically deforming. Additionally or alternatively, the resilient and flexible body may have a modulus of elasticity that is less than 5%, less than 10%, less than 20%, less than 30%, less than 40%, less than 50%, less than 60%, or less than 80% of a modulus of elasticity of another portion of the helmet fit system, such as the left arm, or left primary arm body, of the manual adjustment mechanism and the right arm, or right primary arm body, of the manual adjustment mechanism.

In some examples of passive adjustment mechanisms 30, resilient and flexible body 32 may include one or more webs, or arms, 35 that may interconnect adjacent portions of helmet fit system 12, such as mounts 33, as schematically and optionally illustrated in FIG. 6. Additionally or alternatively, the resilient and flexible body may define a closed loop 37. Additionally or alternatively, the resilient and flexible body may include two spaced apart arms that are interconnected by the webs. Additionally or alternatively, the resilient and flexible body may be defined by a loop of elastic material, and the passive adjustment mechanism further may include a connecting member 39 that interconnects a central region of the loop, such that the resilient and flexible body generally defines a figure-eight shape. Such a configuration that includes central connecting member 39 may restrict splaying, or separating, of arms 35 when a wearer is positioning a helmet 10 on the wearer's head.

Additionally or alternatively, the configuration of passive adjustment mechanism 30 may restrict, prevent, or otherwise generally avoid twisting of resilient and flexible body 32 when a wearer is positioning a helmet 10 on the wearer's head 8. For example, a simple band of elastic fabric may have a tendency to engage the wearer's head and/or become twisted as a helmet is being positioned. In contrast, passive adjustment mechanisms 30 according to the present disclosure may avoid such undesirable twisting.

Figure 7:
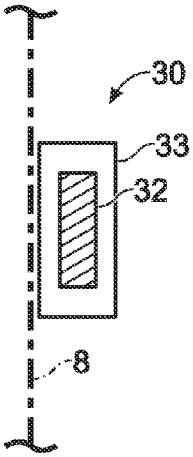
FIG. 7 is a schematic cross-sectional view representing the passive adjustment mechanisms of FIG. 6, taken along line 7-7 in FIG. 6.

In some examples of helmet fit systems 12 that include one or more optional passive adjustment mechanisms 30, the passive adjustment mechanism may be configured so that the resilient and flexible body of the passive adjustment mechanism is spaced away from the wearer's head, such that it does not come into contact, or at least significant contact, with the wearer's head, other than perhaps the wearer's hair or at a maximum a light pressure on the wearer's head. Such a configuration may facilitate avoidance of the resilient and flexible body becoming twisted when a wearer positions the helmet on his/her head. This optional configuration of passive adjustment mechanism 30 is schematically illustrated in FIG. 7, with resilient and flexible body 32 being spaced away from wearer's head 8.

As schematically illustrated in FIGS. 1-2, helmet fit systems 13 also may include a vertical support member, or hanger, 34 that interconnects adjuster assembly 20 of manual adjustment mechanism 18 and a central region of the helmet's shell that is vertically above adjuster assembly 20. When provided, hanger 34 may facilitate proper placement of helmet fit system 13, and thus helmet 15, on wearer's head 8. As optionally illustrated in FIG. 1, hanger 34 may include one or more head support portions 36 that may extend laterally behind the wearer's head, when the helmet is donned by the wearer, such that the head support portions engage a rear surface and/or contour of the wearer's head. In FIG. 1, optional head support portion 36 is schematically illustrated in an overlapping relationship with adjuster assembly 20, schematically representing that the head support portion may be coupled to the adjuster assembly and/or may extend between the adjuster assembly and the wearer's head when the helmet is donned by the wearer. In FIG. 1, the head support portion also is schematically illustrated in an overlapping relationship with shell 14 of the helmet, representing that the head support portion may extend between the shell and the wearer's head when the helmet is donned by the wearer.

Figure 3:
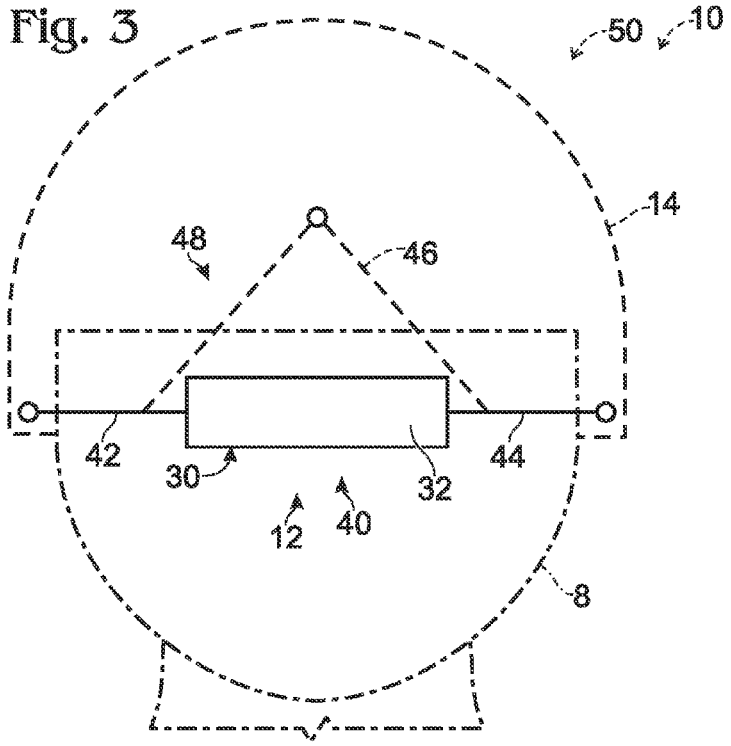
FIG. 3 is a schematic rear view representing additional helmet fit systems and helmets according to the present disclosure.
Figure 4:
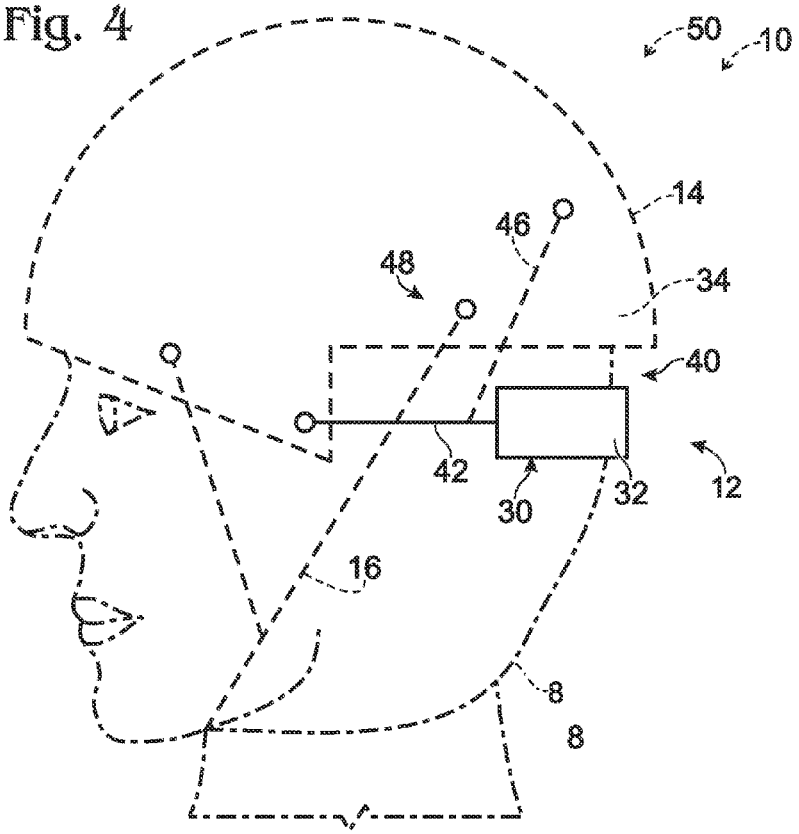
FIG. 4 is a schematic side view representing the helmet fit systems and helmets of FIG. 3.

Turning now to FIGS. 3-4, the schematically represented helmet fit systems 12 may include one or more passive adjustment mechanisms 30, as discussed above with reference to FIGS. 1-2, but without manual adjustment mechanism 18 of helmet fit systems 13 of FIGS. 1-2. Such examples of helmet fit systems 12 are referenced herein as helmet fit systems 40, and helmets 10 that include helmet fit systems 40 are referenced herein as helmets 50. Although not limited to use by children, helmets 50 may be well suited for use by children.

As schematically illustrated, helmet fit systems 40 include at least a left arm 42 and a right arm 44 that interconnects the passive adjustment mechanism 30 to left and right regions of the helmet's shell, respectively. As schematically and optionally illustrated in dashed lines in FIGS. 3-4, helmet fit systems 40 also may include an upper arm 46 that interconnects the passive adjustment mechanism and/or the left and right arms to an upper region of the helmet's shell. When provided, the upper arm 46 may facilitate proper placement of helmet fit system 40, and thus helmet 10, on a wearer's head 8. Collectively, the left, right, and upper arms may define, or be described as, a hanger, or head support frame, 48 that engages a rear surface and/or contour of the wearer's head when the helmet is donned by the wearer.

As discussed, helmets 50 may not include a manual adjustment mechanism 18 according to the present disclosure. In addition, helmets 50 also may not include any adjustment mechanism other than passive adjustment mechanism 30 and an adjustable chin restraint assembly 16. Stated differently, helmet fit system 40 of helmet 50 may not include, may not be required to include, and/or may not utilize any adjustment mechanism that is configured, intended, or otherwise designed to be directly manipulated for selective adjustment of the length of the perimeter that is defined by helmet fit system 40 and the shell, other than small variations in the length of the perimeter due to resilient and flexible body 32 of passive adjustment mechanism 30 being stretched while helmet 50 is being donned.

Figure 9:
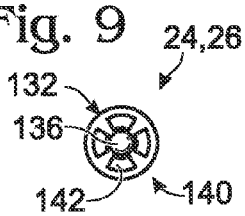
FIG. 9 is a first view of an arm extension that may form a portion of the helmet fit system of FIG. 8.
Figure 11:
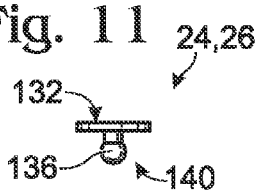
FIG. 11 is a perpendicular view of the arm extension of FIG. 9.
Figure 10:
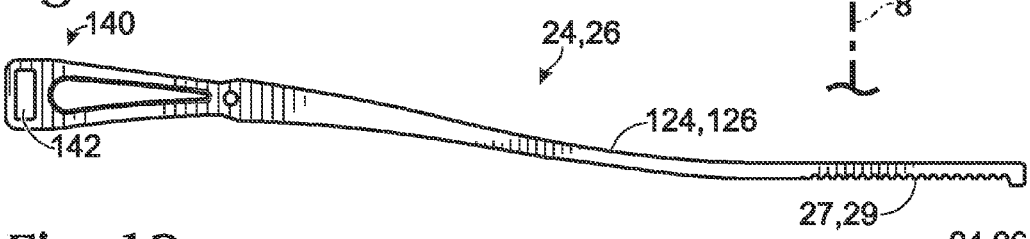
FIG. 10 is a first view of a primary arm body that may form a portion of the helmet fit system of FIG. 8.
Figure 12:
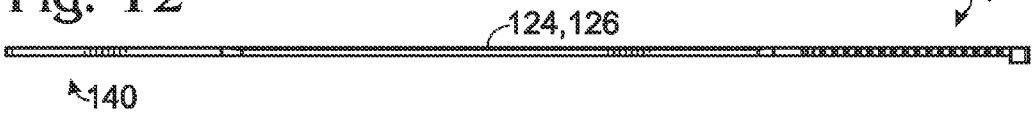
FIG. 12 is a perpendicular view of the primary arm body of FIG. 10.
Figures 8, 13, 14:
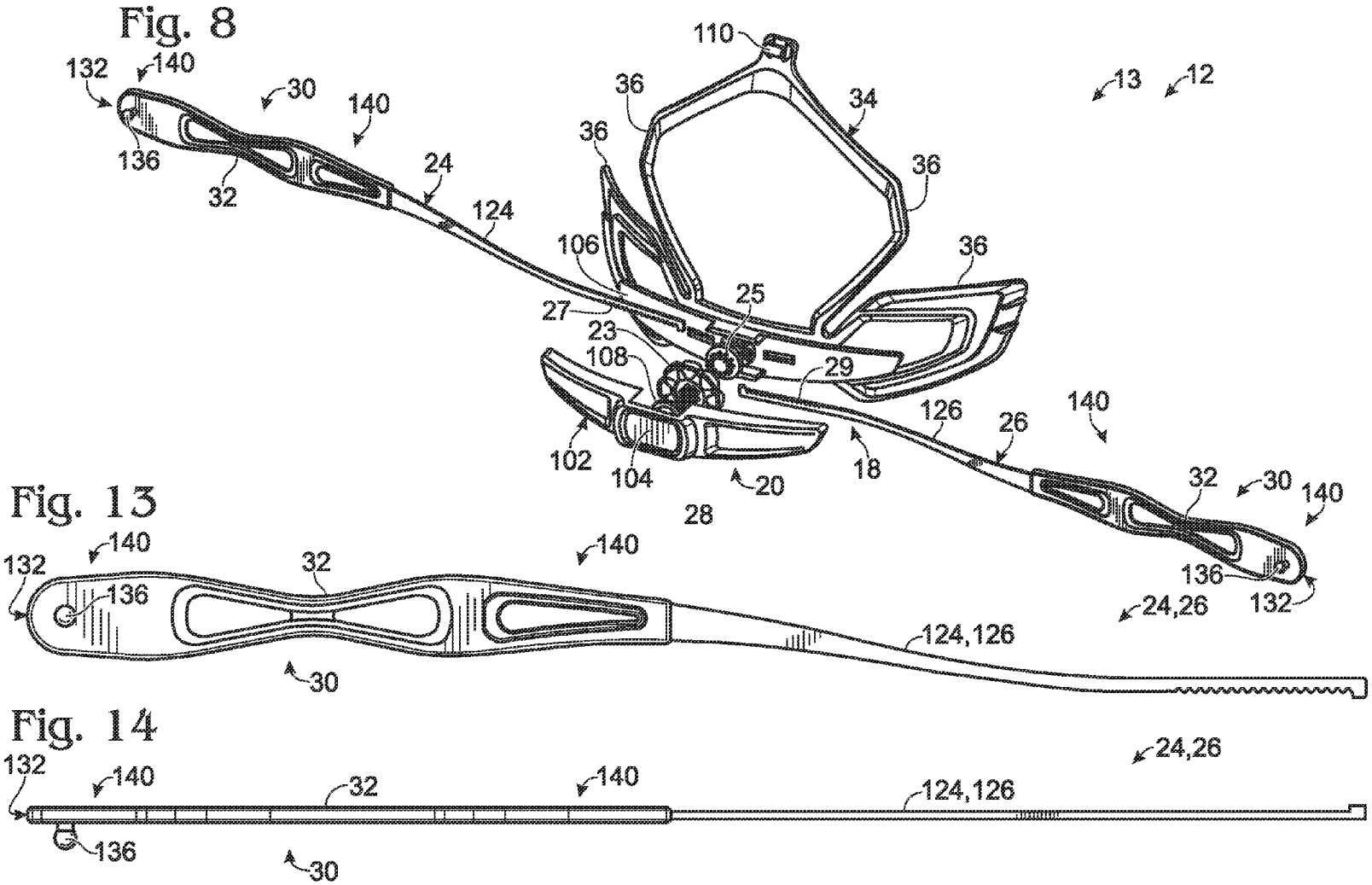
FIG. 8 is a less schematic view of a helmet fit system according to the present disclosure.
FIG. 13 is a first view of an arm that may form a portion of the helmet fit system of FIG. 8.
FIG. 14 is a perpendicular view of the arm of FIG. 13.

FIGS. 8-14 are less schematic views of a helmet fit system 12, according to the present disclosure, and/or components thereof. The helmet fit system of FIGS. 8-14 is a helmet fit system 13 that includes both a manual adjustment mechanism 18 and two passive adjustment mechanisms 30. FIG. 8 is a less schematic view of helmet fit system 13. FIG. 9 is a first view of an arm extension 132 that may form a portion of the helmet fit system of FIG. 8. FIG. 10 is a first view of a primary arm body 124, 126 that may form a portion of the helmet fit system of FIG. 8. FIG. 11 is a perpendicular view of the arm extension of FIG. 9. FIG. 12 is a perpendicular view of the primary arm body of FIG. 10. FIG. 13 is a first view of an arm 24, 26 that may form a portion of the helmet fit system of FIG. 8. FIG. 14 is a perpendicular view of the arm of FIG. 13.

As illustrated in FIG. 8, manual adjustment mechanism 18 includes an adjuster assembly 20 that includes an input wheel 23 for operative tightening and loosening of the helmet fit system. Adjuster assembly 20 includes a housing 102 having a rear housing portion 104 and a forward housing portion 106. Housing 102 operatively supports the input wheel, a pinion gear 25, and a spring 108 that operatively maintains the mesh between racks 27, 29 of left and right arms 24, 26, respectively, and the pinion gear.

Helmet fit system 12 of FIG. 8 also includes a hanger 34. In this example, hanger 34 is operatively coupled to rear housing portion 106 in a snap fit arrangement. Additionally, the hanger is configured to be operatively attached to a central portion of a corresponding helmet's shell and includes a T-boss 110 that is configured to be inserted in and be operatively retained by a slot of a helmet's shell. Hanger 34 is an example of a hanger that includes head support portions 36 that extend laterally so as to engage a rear surface of a wearer's head.

With specific reference to FIGS. 8, 10, and 12-14, left and right arms 24, 26 of helmet fit system 12 each include a respective primary arm body 124, 126 that include racks 27, 29, respectively. Primary arm bodies 124, 126 may be mirror images of each other; however, this is not required.

In addition, and with specific reference to FIGS. 8-9, 11, and 13-14, arm extensions 132 may include and/or define a spherical projection 136, which also may be referred to herein as a mushroom pin 136 and/or as a mushroom head 136 and may be configured to be operatively received within a corresponding socket of a helmet shell, such as in a snap-fit arrangement. Such a configuration may provide operative attachment between left and right arms 24, 26 and the helmet shell while also permitting the arms to pivot and/or rotate relative to the helmet shell. Arm extensions may be identical, or at least substantially identical, to one another; however, this is not required.

In the example of FIGS. 8 and 13-14, passive adjustment mechanism 30 is incorporated into and/or forms a portion of left and right arms 24, 26 of manual adjustment mechanism 18. Primary arm bodies 124, 126 include and/or define respective overmold regions 140, as perhaps best illustrated in FIGS. 10 and 12. Arm extensions 132 also include and/or define respective overmold regions 140, as perhaps best illustrated in FIGS. 9 and 11. Overmold regions 140 may include and/or define recesses 142, as perhaps best illustrated in FIGS. 9-10.

In FIGS. 8-14, passive adjustment mechanisms 30 take the form of resilient and flexible bodies 32 that are formed around, that cover, that are molded over, and/or that are overmolded onto primary arm bodies 124, 126 and arm extensions 132. Stated another way, resilient and flexible bodies 32 extend between and operatively interconnect primary arm bodies 124, 126 and respective arm extensions 132. Recesses 142 may be adapted, configured, sized, and/or shaped to operatively interlock resilient flexible body 32 with the respective primary arm body and/or with the respective arm extension when the resilient and flexible body is formed therearound.

In the example of FIGS. 8-14, resilient and flexible body 32 has and/or defines a figure-eight shape, as discussed herein. However, this specific shape is not required, and any resilient and flexible body that extends between the primary arm bodies and the respective arm extensions may be utilized without departing from the scope of the present disclosure. Examples of such resilient and flexible bodies are disclosed herein.

Figure 15:
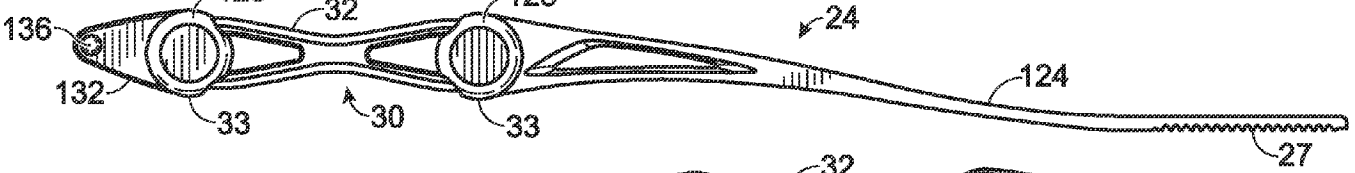
FIG. 15 is a first view of an alternative arm that may form a portion of the helmet fit system of FIG. 8.
Figure 16:
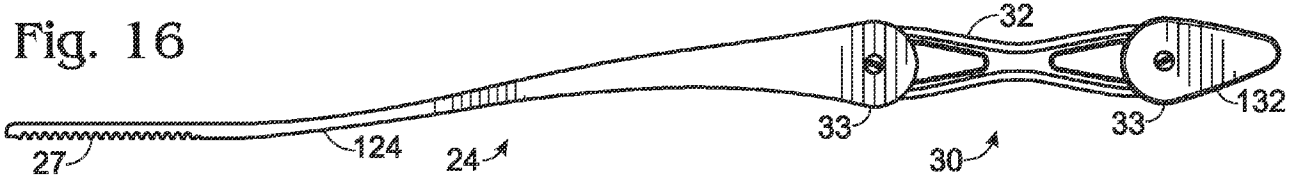
FIG. 16 is a second view of the arm of FIG. 15.
Figure 17:
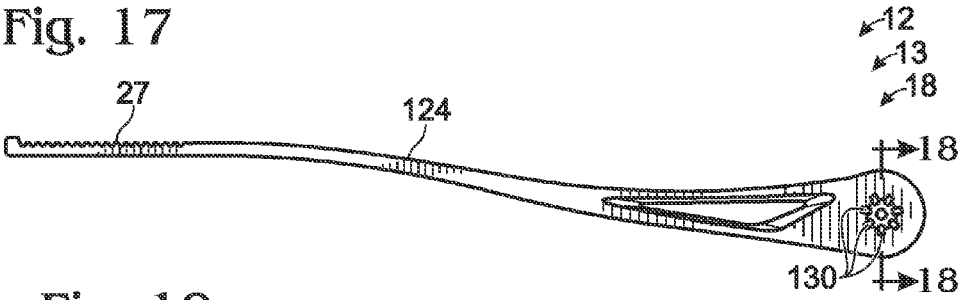
FIG. 17 is a first view of a primary arm body that may form a portion of the alternative arm of FIGS. 15-16.
Figure 18:
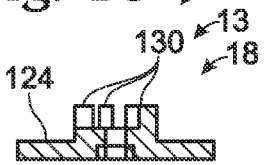
FIG. 18 is a cross-sectional view of the primary arm body of FIG. 17 taken along line 18-18 of FIG. 17.
Figure 19:
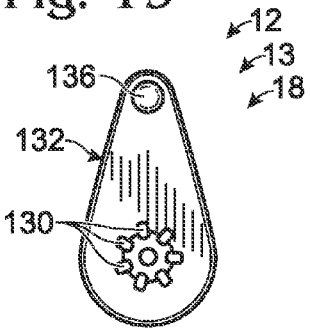
FIG. 19 is a first view of an arm extension that may form a portion of the alternative arm of FIGS. 15-16.
Figure 21:
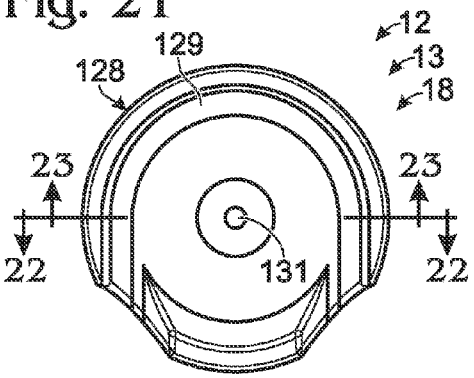
FIG. 21 is a view of an example of a cap that may form a portion of the alternative arm of FIGS. 15-16.
Figure 20:
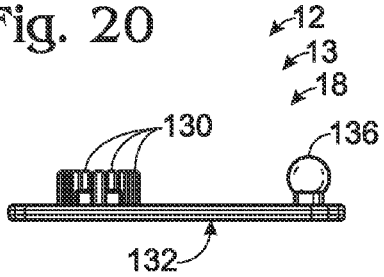
FIG. 20 is a second view of the arm extension of FIG. 19.
Figure 22:
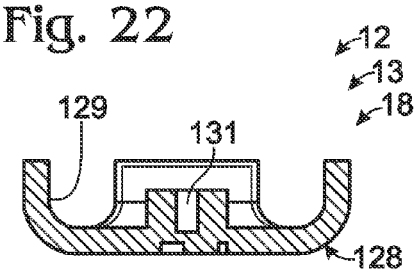
FIG. 22 is a cross-sectional view of the cap of FIG. 21 taken along line 22-22 of FIG. 21.
Figure 23:
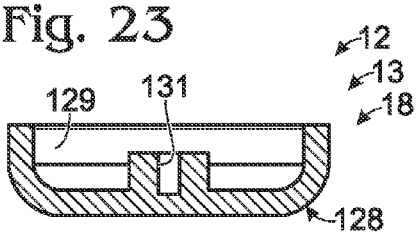
FIG. 23 is a cross-sectional view of the cap of FIG. 21 taken along line 23-23 of FIG. 21.
Figure 25:
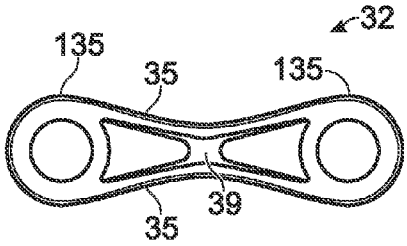
FIG. 25 is an example of a resilient and flexible body according to the present disclosure.
Figure 26:
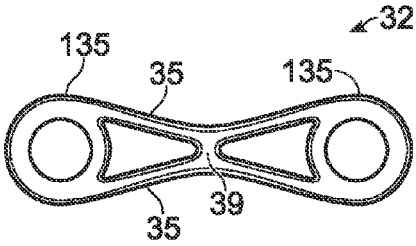
FIG. 26 is an example of a resilient and flexible body according to the present disclosure.

FIGS. 15-23 are less schematic views of an alternative left arm 24 that may be utilized with the helmet fit system of FIG. 8. More specifically, FIG. 15 is a first view of the alternative left arm, and FIG. 16 is a second view of the arm of FIG. 15. FIG. 17 is a first view of a primary arm body 124 that may form a portion of the alternative arm of FIGS. 15-16, while FIG. 18 is a second view of the primary arm body of FIG. 17. FIG. 19 is a first view of an arm extension 132 that may form a portion of the alternative arm of FIGS. 15-16, while FIG. 20 is a second view of the arm extension of FIG. 19. FIG. 21 is a view of an example of a cap 128 that may form a portion of the alternative arm of FIGS. 15-16, FIG. 22 is a cross-sectional view of the cap of FIG. 21 taken along line 22-22 of FIG. 22, and FIG. 23 is a cross-sectional view of the cap of FIG. 21 take along line 23-23 of FIG. 22. FIGS. 15-23 illustrate left arm 24; however, it is within the scope of the present disclosure that helmet fit systems 13 may include and/or utilize a right arm that is similar to and/or that includes similar structures, components, and/or functions as those discussed herein with respect to left arm 24.

As illustrated in FIGS. 15-16, and similar to left and right arms 24, 26 of FIGS. 8-14, alternative left arm 24 includes a primary arm body 124 that includes and/or defines a rack 27. In addition, alternative left arm 24 also includes an arm extension 132 that includes a spherical projection 136 and a passive adjustment mechanism 30 that includes a resilient and flexible body 32 and that extends between the primary arm body and the arm extension.

However, and in contrast to left and right arms 24, 26 of FIGS. 8-14, primary arm body 124 and arm extension 132 include and/or define mounts 33 that, together with corresponding caps 128, are configured to operatively attach resilient and flexible body 32 to primary arm body 124 and to arm extension 132. Examples of resilient and flexible body 32 are disclosed herein.

As illustrated in FIGS. 17-18, primary arm body 124 may include and/or define ribs 130. The ribs may project and/or extend from a remainder of the primary arm body in a spaced-apart, radially symmetric circular configuration and may be adapted, configured, sized, and/or shaped to contact resilient and flexible body 32. As illustrated in FIGS. 19-20, arm extension 132 also may include and/or define ribs 130, which may be similar, or even identical, to ribs 130 of primary arm body 124. Ribs 130 together with caps 128 operatively retain resilient and flexible body 32 to primary arm body 124 or arm extension 132.

As illustrated in FIGS. 21-23, caps 128 may include and/or define a recessed channel 129 that is configured to receive a portion of the resilient and flexible body. Cap 128 and/or recessed channel 129 thereof may be configured to operatively interlock with the resilient and flexible body, to surround the portion of the resilient and flexible body, and/or to retain the portion of the resilient and flexible body.

Caps 128 may be mirror images of each other and may be coupled to primary arm body 124 with a cap screw, effectively retaining one end of the resilient and flexible body. Thus, caps 128 also may include a threaded region 131 that may be configured to receive and/or to interlock with the cap screw. Similar and/or identical resilient and flexible bodies 32, arm extensions 132, and/or caps 128 may be used in connection with both of the left and right arms of a helmet fit system 13 that includes the alternative arm that is illustrated in FIGS. 15-23.

Figure 24:
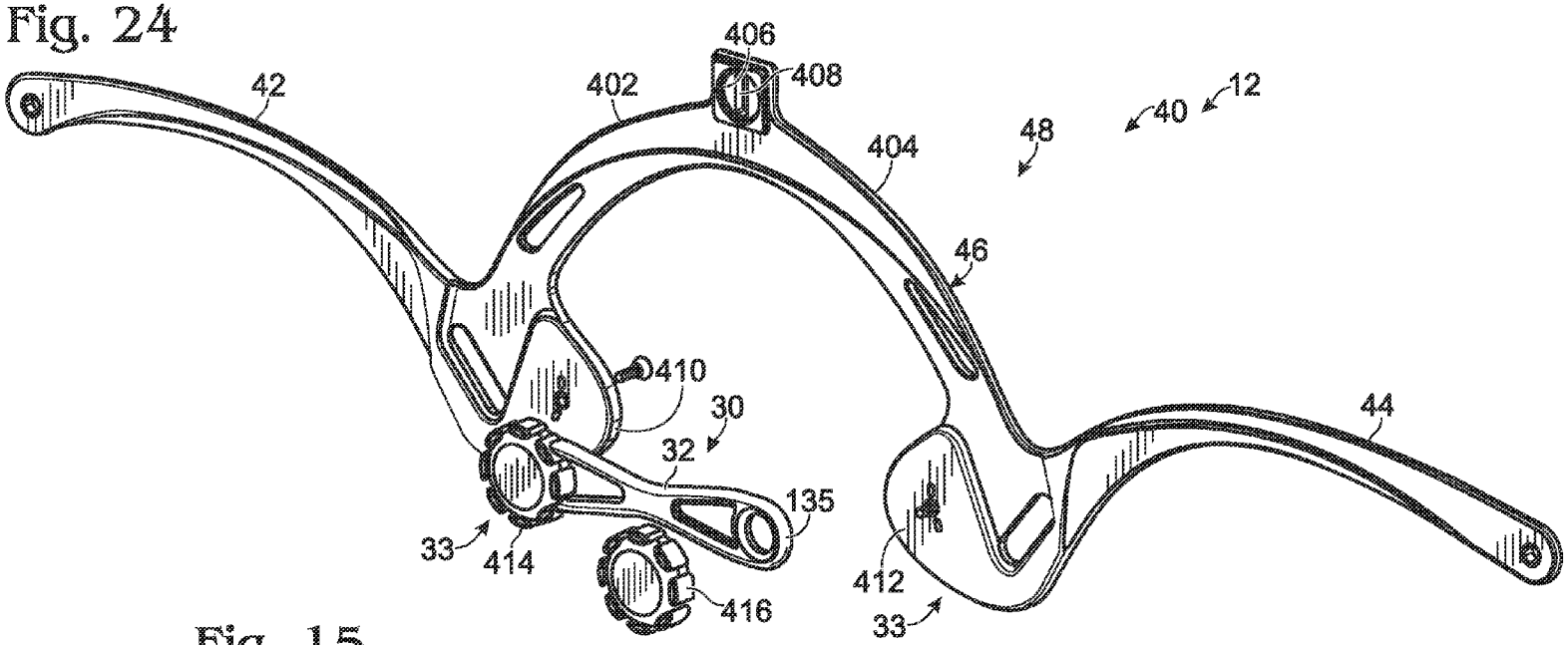
FIG. 24 is a less schematic view of a helmet fit system according to the present disclosure.

FIG. 24 is a less schematic view of a helmet fit system 12 according to the present disclosure. The helmet fit system of FIG. 24 is a helmet fit system 40 that includes a passive adjustment mechanism 30 but that does not include a manual adjustment mechanism. In addition, helmet fit system 40 of FIG. 24 includes only a single passive adjustment mechanism 30. Helmet fit system 40 includes a support frame 48 having a left arm 42, a right arm 44, and an upper arm 46. The upper arm of the support frame includes a left portion 402 and a right portion 404 that generally defines a downward directed arc that interconnects the left and right arms 42, 44. The upper arm also includes a tab 406 extending upward from a center region of the upper arm and defining a rectangular slot 408 that is operatively configured to mate with a corresponding anchor of a helmet shell.

As illustrated, passive adjustment mechanism 30 includes a resilient and flexible body 32. The resilient and flexible body may include any suitable shape and/or structure, examples of which are disclosed herein.

The helmet fit system of FIG. 24 also includes mounts 33. The mounts 33 are collectively defined by left and right regions 410, 412 of the support frame 48, and left and right caps 414, 416 that are operatively secured to the left and right regions by cap screws. Circular end regions 135 of resilient and flexible body 32 are thereby operatively captured between the caps and the support frame.

FIGS. 25-30 provide additional examples of resilient and flexible bodies 32 that may be included in, that may be utilized with, and/or that may form a portion of passive adjustment mechanisms 30 according to the present disclosure. As illustrated in FIGS. 25-29, resilient and flexible bodies 32 may include and/or be molded and/or pre-formed resilient and flexible bodies. As illustrated in FIGS. 25-28 and 30-31, resilient and flexible bodies 32 may include and/or define a figure-eight shape. As illustrated in FIGS. 25-28, resilient and flexible bodies 32 may include and/or define circular end regions 135. The circular end regions may be shaped and/or sized to receive a portion of mounts 33, to extend around ribs 130, and/or to extend within recessed channels 129 of caps 128, as discussed herein.

Figure 27:
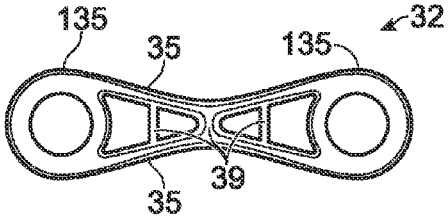
FIG. 27 is an example of a resilient and flexible body according to the present disclosure.
Figure 28:
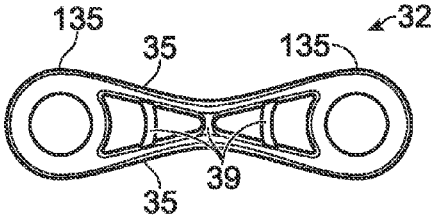
FIG. 28 is an example of a resilient and flexible body according to the present disclosure.
Figure 30:
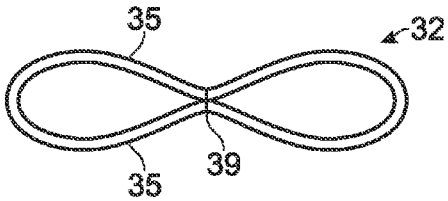
FIG. 30 is an example of a resilient and flexible body according to the present disclosure.
Figure 31:
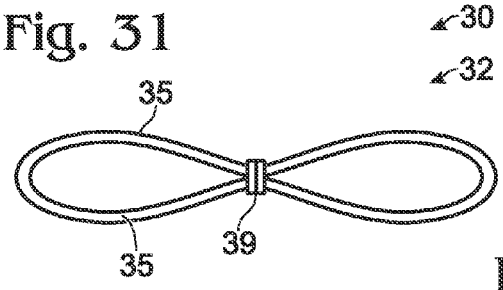
FIG. 31 is an example of a resilient and flexible body according to the present disclosure.

As illustrated in FIGS. 25-26 and 30-31, a single and/or a central connecting member 39 may extend between and/or interconnect two arms 35 of the resilient and flexible body. Alternatively, and as illustrated in FIGS. 27-28, a plurality of connecting members 39 may extend between arms 35. The connecting members may be formed with and/or integral to a remainder of the resilient and flexible body, as illustrated in FIGS. 25-28. Alternatively, the connecting members may be operatively attached to a remainder of the resilient and flexible body, as illustrated in FIGS. 30-31.

Figure 29:
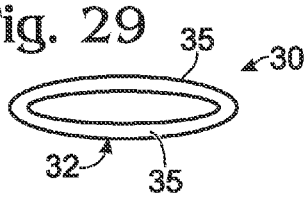
FIG. 29 is an example of a resilient and flexible body according to the present disclosure.
Figure 32:
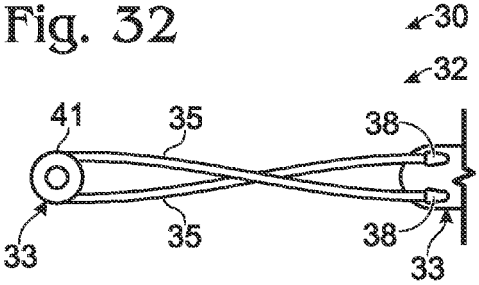
FIG. 32 is an example of a resilient and flexible body according to the present disclosure.

FIGS. 29-31 illustrate that resilient and flexible body 32 may include and/or be a loop, or circle, that may (as illustrated in FIGS. 30-31) or may not (as illustrated in FIG. 29) define the figure-eight shape. FIG. 32 illustrates an alternative embodiment for the resilient and flexible body in which the resilient and flexible body includes two ends 38 that are operatively attached to a first mount 33 and a loop 41 that extends around a second mount 33.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

Illustrative, non-exclusive examples of helmet fit systems and/or helmets, according to the present disclosure, are presented in the following enumerated paragraphs.

A. A helmet fit system, comprising:

a means for manually adjusting a perimeter that is defined by a helmet and the helmet fit system when the helmet fit system is operatively coupled to the helmet, wherein the perimeter is configured to receive a head of a wearer when the helmet is donned by the wearer; and a means for automatically and passively varying a length of the perimeter responsive to a tension force that is applied to the means for automatically and passively varying by the means for manually adjusting when the helmet is donned by the wearer.

B. A helmet fit system, comprising:

a manual adjustment mechanism configured to be operatively coupled to a shell of a helmet and, together with the shell, to define a perimeter within which a head of a wearer is positioned when the helmet is donned by the wearer, wherein the manual adjustment mechanism is configured to receive user input for selectively increasing and decreasing a length of the perimeter; and at least one passive adjustment mechanism configured to automatically and passively vary the length of the perimeter responsive to a tension force that is applied to the passive adjustment mechanism by a remainder of the helmet fit system when the helmet is donned by the wearer.

B1. The system of paragraph B, wherein the manual adjustment mechanism includes an adjuster assembly including a user input member, a left arm configured to operatively interconnect the adjuster assembly to a left region of the shell, and a right arm configured to operatively interconnect the adjuster assembly to a right region of the shell.

B2. The system of paragraph B1, wherein the left arm includes a left rack gear, wherein the right arm includes a right rack gear, wherein the user input member includes an input wheel that is operatively attached to a pinion gear, and further wherein the pinion gear is operatively meshed with the left rack gear and with the right rack gear such that rotation of the input wheel operatively translates the left rack gear and the right rack gear relative to one another to change the length of the perimeter.

B3. The system of any of paragraphs B1-B2, wherein the left arm and the right arm are formed from a molded plastic that is resilient and flexible along a lateral direction and stiff along a longitudinal length of the left arm and of the right arm.

B4. The system of any of paragraphs B1-B3, wherein the manual adjustment mechanism is configured to incrementally adjust the length of the perimeter in increments of 1 millimeter (mm), 2 mm, 3 mm, 4 mm, 5 mm, 1-5 mm, 2-5 mm, 3-5 mm, 4-5 mm, 1-4 mm, 2-4 mm, 3-4 mm, 1-3 mm, 2-3 mm, 1-2 mm, less than 1 mm, or more than 5 mm.

B5. The system of any of paragraphs B1-B4, wherein the helmet fit system further includes a vertical support member that interconnects the adjuster assembly and the shell.

B6. The system of any of paragraphs B-B5, wherein the passive adjustment mechanism is configured to at least one of increase the length of the perimeter and decrease the length of the perimeter.

B7. The system of any of paragraphs B-B6, wherein, responsive to application of the tension force thereto, the passive adjustment mechanism is configured to elastically deform to automatically and passively vary the length of the perimeter.

B8. The system of any of paragraphs B-B7, wherein, responsive to application of the tension force thereto, the passive adjustment mechanism is configured to automatically and passively transition among a range of lengths.

B9. The system of paragraph B8, wherein the range of lengths includes an infinitely variable number of lengths.

B10. The system of any of paragraphs B-B9, wherein the manual adjustment mechanism has a plurality of discrete adjustments that discretely adjust the length of the perimeter, and further wherein the passive adjustment mechanism is configured to adjust the length of the perimeter between adjacent adjustments of the plurality of discrete adjustments.

B11. The system of paragraph B10, wherein the passive adjustment mechanism is configured to continuously adjust the length of the perimeter between adjacent adjustments of the plurality of discrete adjustments.

B12. The system of any of paragraphs B-B11, wherein the passive adjustment mechanism is free of structures configured to receive direct user input for adjustment of the helmet fit system.

B13. The system of any of paragraphs B-B12, wherein the passive adjustment mechanism is configured to provide selective increase and decrease in the length of the perimeter.

B14. The system of any of paragraphs B-B13, wherein the passive adjustment mechanism is operatively coupled to at least one, and optionally both, of a/the right arm of the manual adjustment mechanism and a/the left arm of the manual adjustment mechanism.

B15. The system of paragraph B14, wherein the passive adjustment mechanism is a first passive adjustment mechanism that is operatively coupled to the right arm of the manual adjustment mechanism, and further wherein the helmet fit system includes a second passive adjustment mechanism that is operatively coupled to the left arm of the manual adjustment mechanism, wherein the first passive adjustment mechanism is configured to automatically and passively vary a length of the right arm, and further wherein the second passive adjustment mechanism is configured to automatically and passively vary a length of the left arm.

B16. The system of any of paragraphs B-B15, wherein at least one of a/the right arm of the manual adjustment mechanism and a/the left arm of the manual adjustment mechanism includes the passive adjustment mechanism.

B17. The system of any of paragraphs B-B16, wherein the passive adjustment mechanism operatively couples at least one of a/the right arm of the manual adjustment mechanism and a/the left arm of the manual adjustment mechanism to the shell.

B18. The system of any of paragraphs B-B17, wherein the passive adjustment mechanism operatively couples at least one of a/the right arm of the manual adjustment mechanism and a/the left arm of the manual adjustment mechanism to a/the adjuster assembly of the manual adjustment mechanism.

B19. The system of any of paragraphs B-B18, wherein the passive adjustment mechanism is positioned generally on a lateral side of the wearer's head when the helmet is donned by the wearer.

C. A helmet fit system, comprising:

a left arm configured to be operatively coupled to a left region of a shell of a helmet;

a right arm configured to be operatively coupled to a right region of the shell; and a passive adjustment mechanism interconnecting the left arm and the right arm and configured to be positioned at the rear of a head of a wearer.

C1. The system of paragraph C, wherein the helmet fit system is free from a manual adjustment mechanism.

C2. The system of any of paragraphs C-C1, wherein the helmet fit system further includes an upper arm interconnecting the left arm and the right arm and configured to be operatively coupled to an upper region of the shell.

C3. The system of any of paragraphs C-C2, wherein the helmet fit system further includes an/the upper arm interconnecting the passive adjustment mechanism and an/the upper region of the shell.

C4. The system of paragraph C3, wherein the left arm, the right arm, and the upper arm together define a hanger that engages a rear surface of the wearer's head when the helmet is donned by the wearer.

D1. The system of any of paragraphs A-C4, wherein a/the passive adjustment mechanism includes a resilient and flexible body configured to reversibly stretch in a longitudinal direction that is aligned with a/the perimeter to automatically and passively vary a/the length of the perimeter.

D2. The system of paragraph D1, wherein the passive adjustment mechanism includes a pair of mounts, and further wherein the resilient and flexible body extends between the pair of mounts.

D3. The system of paragraph D2, wherein at least one of the pair of mounts includes an overmold region, and further wherein the resilient and flexible body is molded around the overmold region.

D4. The system of any of paragraphs D2-D3, wherein at least one of the pair of mounts includes a cap configured to operatively retain the resilient and flexible body in mechanical contact with a/the right arm, a/the left arm, a/the shell, and a/the adjuster assembly.

D5. The system of paragraph D4, wherein the cap includes a recessed channel configured to receive a portion of the resilient and flexible body.

D6. The system of any of paragraphs D1-D5, wherein the resilient and flexible body includes, or is formed from, at least one of rubber, synthetic rubber, elastic, plastic, elastomer, thermoplastic, thermoplastic polyurethane (TPU), soft TPU, thermoplastic elastomer (TPE), soft TPE, and/or thermoplastic rubber.

D7. The system of any of paragraphs D1-D6, wherein the resilient and flexible body has a modulus of elasticity of at least one of 1-5 megapascals (MPa), 1-4 MPa, 1-3 MPa, 1-2 MPa, 2-5 MPa, 2-4 MPa, 2-3 MPa, 3-5 MPa, 3-4 MPa, or 4-5 MPa.

D8. The system of any of paragraphs D1-D7, wherein the resilient and flexible body has a/the modulus of elasticity that is at least one of less than 5%, less than 10%, less than 20%, less than 30%, less than 40%, less than 50%, less than 60%, or less than 80% of a modulus of elasticity of at least one of a/the left arm of a/the manual adjustment mechanism and a/the right arm of a/the manual adjustment mechanism.

D9. The system of any of paragraphs D1-D8, wherein the resilient and flexible body elastically deforms when stretched to at least one of 1.1-2 times its non-stretched length, 1.1-1.5 times its non-stretched length, 1.1-1.2 times its non-stretched length, 1.2-2 times its non-stretched length, 1.2-1.5 times its non-stretched length, or 1.5-2 times its non-stretched length.

D10. The system of any of paragraphs D1-D9, wherein the resilient and flexible body is configured to elastically stretch along its length by at least one of 1-50 mm, 1-40 mm, 1-30 mm, 1-20 mm, 1-10 mm, 10-50 mm, 10-40 mm, 10-30 mm, 10-20 mm, 20-50 mm, 20-40 mm, 20-30 mm, 30-50 mm, 30-40 mm, or 40-50 mm.

D11. The system of any of paragraphs D1-D10, wherein the resilient and flexible body at least one of:

(i) includes a plurality of webs;

(ii) defines a closed loop;

(iii) includes two spaced-apart arms that are interconnected by at least one connecting member; and (iv) defines a figure-eight shape.

E. A helmet comprising:

a shell; and the helmet fit system of any of paragraphs A-D11 operatively coupled to the shell to define a/the perimeter.

F. A helmet comprising:

a shell; and a helmet fit system, wherein the helmet fit system includes:

(i) a manual adjustment mechanism operatively coupled to the shell and, together with the shell, defining a perimeter within which a head of a wearer is positioned when the helmet is donned by the wearer, wherein the manual adjustment mechanism includes an adjuster assembly including a user input member configured to receive user input for selectively increasing and decreasing a length of the perimeter, wherein the manual adjustment mechanism further includes a left arm configured to operatively interconnect the adjuster assembly to a left region of the shell, wherein the manual adjustment mechanism further includes a right arm configured to operatively interconnect the adjuster assembly to a right region of the shell, and wherein the manual adjustment mechanism further includes at least one arm extension that operatively couples the helmet fit system to the shell; and (ii) at least one passive adjustment mechanism configured to automatically and passively vary the length of the perimeter responsive to a tension force that is applied to the passive adjustment mechanism by a remainder of the helmet fit system when the helmet is donned by the wearer, wherein the passive adjustment mechanism includes a resilient and flexible body configured to reversibly stretch in a longitudinal direction that is aligned with the perimeter to automatically and passively vary the length of the perimeter, wherein the resilient and flexible body extends between the at least one arm extension and the adjuster assembly of the manual adjustment mechanism, wherein the resilient and flexible body has a modulus of elasticity that is less than 30% of a modulus of elasticity of at least one of the left arm of the manual adjustment mechanism and the right arm of the manual adjustment mechanism.

F1. The helmet of paragraph F, wherein the left arm includes a left rack gear, wherein the right arm includes a right rack gear, wherein the user input member includes an input wheel that is operatively attached to a pinion gear, and further wherein the pinion gear is operatively meshed with the left rack gear and with the right rack gear such that rotation of the input wheel operatively translates the left rack gear and the right rack gear relative to one another to change the length of the perimeter.

F2. The helmet of paragraph F, wherein the manual adjustment mechanism is configured to incrementally adjust the length of the perimeter.

F3. The helmet of paragraph F, wherein the helmet fit system further includes a vertical support member that interconnects the adjuster assembly and the shell.

F4. The helmet of paragraph F, wherein the at least one arm extension includes a first arm extension and a second arm extension, wherein the right arm includes the first arm extension and the left arm includes the second arm extension, wherein the resilient and flexible body is a first resilient and flexible body that is coupled to the right arm between the first arm extension and the adjuster assembly of the manual adjustment mechanism, wherein the helmet fit system includes a second passive adjustment mechanism that includes a second resilient and flexible body that is coupled to the left arm between the second arm extension and the adjuster assembly of the manual adjustment mechanism, wherein the first passive adjustment mechanism is configured to automatically and passively vary a length of the right arm, and further wherein the second passive adjustment mechanism is configured to automatically and passively vary a length of the left arm.

F5. The helmet of paragraph F, wherein, responsive to application of the tension force thereto, the passive adjustment mechanism is configured to elastically deform to automatically and passively vary the length of the perimeter.

F6. The helmet of paragraph F, wherein, responsive to application of the tension force thereto, the passive adjustment mechanism is configured to automatically and passively transition among a range of lengths.

F7. The helmet of paragraph F6, wherein the range of lengths includes an infinitely variable number of lengths.

F8. The helmet of paragraph F, wherein the manual adjustment mechanism has a plurality of discrete adjustments that discretely adjust the length of the perimeter, and further wherein the passive adjustment mechanism is configured to continuously adjust the length of the perimeter between the plurality of discrete adjustments.

F9. The helmet of paragraph F, wherein the passive adjustment mechanism includes a pair of mounts, and further wherein the resilient and flexible body extends between the pair of mounts.

F10. The helmet of paragraph F9, wherein at least one of the pair of mounts includes an overmold region, and further wherein the resilient and flexible body is molded around the overmold region.

F11. The helmet of paragraph F, wherein the resilient and flexible body includes at least one of rubber, synthetic rubber, elastic, plastic, elastomer, thermoplastic, thermoplastic polyurethane (TPU), soft TPU, thermoplastic elastomer (TPE), soft TPE, and thermoplastic rubber.

G. A helmet comprising:

a shell; and a helmet fit system, wherein the helmet fit system includes:

(i) a manual adjustment mechanism operatively coupled to the shell and, together with the shell, defining a perimeter within which a head of a wearer is positioned when the helmet is donned by the wearer, wherein the manual adjustment mechanism is configured to receive user input for selectively increasing and decreasing a length of the perimeter, wherein the manual adjustment mechanism includes an adjuster assembly including a user input member, a left arm operatively interconnecting the adjuster assembly to a left region of the shell, a right arm operatively interconnecting the adjuster assembly to a right region of the shell, wherein the left arm includes a left arm extension coupled to the left region of the shell, and wherein the right arm includes a right arm extension coupled to the right region of the shell;

(ii) two passive adjustment mechanisms configured to automatically and passively vary the length of the perimeter responsive to a tension force that is applied to the two passive adjustment mechanisms by a remainder of the helmet fit system when the helmet is donned by the wearer, wherein the two passive adjustment mechanisms include a left resilient and flexible body that is positioned between the left arm extension and the adjuster assembly, and a right resilient and flexible body that is positioned between the right arm extension and the adjuster assembly, wherein the left resilient and flexible body and the right resilient and flexible body are configured to reversibly stretch in a longitudinal direction that is aligned with the perimeter to automatically and passively vary the length of the perimeter, and the left resilient and flexible body and the right resilient and flexible body have a modulus of elasticity that is less than 30% of a modulus of elasticity of the left arm and the right arm of the manual adjustment mechanism.

INDUSTRIAL APPLICABILITY

The systems and methods disclosed herein are applicable to the helmet and helmet fit system industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A helmet comprising:

a shell; and a helmet fit system, wherein the helmet fit system includes:

a manual adjustment mechanism operatively coupled to the shell and, together with the shell, defining a perimeter within which a head of a wearer is positioned when the helmet is donned by the wearer, wherein the manual adjustment mechanism includes an adjuster assembly including a user input member configured to receive user input for selectively increasing and decreasing a length of the perimeter, wherein the manual adjustment mechanism further includes a left arm configured to operatively interconnect the adjuster assembly to a left region of the shell, wherein the manual adjustment mechanism further includes a right arm configured to operatively interconnect the adjuster assembly to a right region of the shell, and wherein the manual adjustment mechanism further includes at least one arm extension that operatively couples the helmet fit system to the shell; and (ii) at least one passive adjustment mechanism configured to automatically and passively vary the length of the perimeter responsive to a tension force that is applied to the passive adjustment mechanism by a remainder of the helmet fit system when the helmet is donned by the wearer, wherein the passive adjustment mechanism includes a resilient and flexible body configured to reversibly stretch in a longitudinal direction that is aligned with the perimeter to automatically and passively vary the length of the perimeter, wherein the resilient and flexible body extends between the at least one arm extension and the adjuster assembly of the manual adjustment mechanism, wherein the resilient and flexible body has a modulus of elasticity that is less than 30% of a modulus of elasticity of at least one of the left arm of the manual adjustment mechanism and the right arm of the manual adjustment mechanism.

2. The helmet of claim 1, wherein the left arm includes a left rack gear, wherein the right arm includes a right rack gear, wherein the user input member includes an input wheel that is operatively attached to a pinion gear, and further wherein the pinion gear is operatively meshed with the left rack gear and with the right rack gear such that rotation of the input wheel operatively translates the left rack gear and the right rack gear relative to one another to change the length of the perimeter.

3. The helmet of claim 1, wherein the manual adjustment mechanism is configured to incrementally adjust the length of the perimeter.

4. The helmet of claim 1, wherein the helmet fit system further includes a vertical support member that interconnects the adjuster assembly and the shell.

5. The helmet of claim 1, wherein the at least one arm extension includes a first arm extension and a second arm extension, wherein the right arm includes the first arm extension and the left arm includes the second arm extension, wherein the resilient and flexible body is a first resilient and flexible body that is coupled to the right arm between the first arm extension and the adjuster assembly of the manual adjustment mechanism, wherein the helmet fit system includes a second passive adjustment mechanism that includes a second resilient and flexible body that is coupled to the left arm between the second arm extension and the adjuster assembly of the manual adjustment mechanism, wherein the first passive adjustment mechanism is configured to automatically and passively vary a length of the right arm, and further wherein the second passive adjustment mechanism is configured to automatically and passively vary a length of the left arm.

6. The helmet of claim 1, wherein, responsive to application of the tension force thereto, the passive adjustment mechanism is configured to elastically deform to automatically and passively vary the length of the perimeter.

7. The helmet of claim 1, wherein, responsive to application of the tension force thereto, the passive adjustment mechanism is configured to automatically and passively transition among a range of lengths.

8. The helmet of claim 7, wherein the range of lengths includes an infinitely variable number of lengths.

9. The helmet of claim 1, wherein the manual adjustment mechanism has a plurality of discrete adjustments that discretely adjust the length of the perimeter, and further wherein the passive adjustment mechanism is configured to continuously adjust the length of the perimeter between the plurality of discrete adjustments.

10. The helmet of claim 1, wherein the passive adjustment mechanism includes a pair of mounts, and further wherein the resilient and flexible body extends between the pair of mounts.

11. The helmet of claim 10, wherein at least one of the pair of mounts includes an overmold region, and further wherein the resilient and flexible body is molded around the overmold region.

12. The helmet of claim 1, wherein the resilient and flexible body includes at least one of rubber, synthetic rubber, elastic, plastic, elastomer, thermoplastic, thermoplastic polyurethane (TPU), soft TPU, thermoplastic elastomer (TPE), soft TPE, and thermoplastic rubber.

13. A helmet comprising:

a shell; and a helmet fit system, wherein the helmet fit system includes:

(i) a manual adjustment mechanism operatively coupled to the shell and, together with the shell, defining a perimeter within which a head of a wearer is positioned when the helmet is donned by the wearer, wherein the manual adjustment mechanism is configured to receive user input for selectively increasing and decreasing a length of the perimeter, wherein the manual adjustment mechanism includes an adjuster assembly including a user input member, a left arm operatively interconnecting the adjuster assembly to a left region of the shell, a right arm operatively interconnecting the adjuster assembly to a right region of the shell, wherein the left arm includes a left arm extension coupled to the left region of the shell, and wherein the right arm includes a right arm extension coupled to the right region of the shell;

(ii) two passive adjustment mechanisms configured to automatically and passively vary the length of the perimeter responsive to a tension force that is applied to the two passive adjustment mechanisms by a remainder of the helmet fit system when the helmet is donned by the wearer, wherein the two passive adjustment mechanisms include a left resilient and flexible body that is positioned between the left arm extension and the adjuster assembly, and a right resilient and flexible body that is positioned between the right arm extension and the adjuster assembly, wherein the left resilient and flexible body and the right resilient and flexible body are configured to reversibly stretch in a longitudinal direction that is aligned with the perimeter to automatically and passively vary the length of the perimeter, and the left resilient and flexible body and the right resilient and flexible body have a modulus of elasticity that is less than 30% of a modulus of elasticity of the left arm and the right arm of the manual adjustment mechanism.

* * * * *